United States Patent [19]

Isowa

[11] 4,297,968

[45] Nov. 3, 1981

[54] DEVICE FOR SPREADING PASTE ON PAPERBOARD IN A CORRUGATED BOARD MANUFACTURING APPARATUS

[75] Inventor: Eiichi Isowa, Nagoya, Japan

[73] Assignee: Isowa Industry Co., Ltd., Japan

[21] Appl. No.: 117,074

[22] Filed: Jan. 31, 1980

[51] Int. Cl.[3] ..... B05C 1/08; B05C 1/16

[52] U.S. Cl. ..... 118/249; 118/258; 118/262; 101/363

[58] Field of Search ..... 118/258, 262, 259, 261, 118/407, 413, 249, 211; 101/363

[56] References Cited

U.S. PATENT DOCUMENTS

| | | | |
|---|---|---|---|
| 2,674,299 | 4/1954 | Bruker | 118/262 X |
| 3,032,007 | 5/1962 | McCauliff | 118/259 X |
| 3,936,549 | 2/1976 | Kohler et al. | 118/259 X |

*Primary Examiner*—John P. McIntosh

*Attorney, Agent, or Firm*—Basile, Weintraub & Hanlon

[57] ABSTRACT

A device for spreading paste on paperboard in a corrugated board manufacturing apparatus is herein disclosed. The device comprises a supplier for supplying liquid paste, a roller for spreading the liquid paste on tops of core paper to be pasted with linerboard, a member for controlling the volume of the liquid paste, a paste feeding member provided under the supplier downwardly inclinedly toward the paste spreading roller to define a passage for the liquid paste, at least a pair of movable end plates provided in the forward end of the paste feeding member and defining a certain clearance between the upper surfaces thereof and the paste spreading roller and a feed portion defined by the end plates to communicate with the passage. The width of the feed portion is adjustable by movement of the end plates in conformity with the width of the core paper between a minimum effective width and a maximum effective width.

9 Claims, 7 Drawing Figures

DEVICE FOR SPREADING PASTE ON PAPERBOARD IN A CORRUGATED BOARD MANUFACTURING APPARATUS

BACKGROUND OF THE INVENTION

1. Field of the Invention

The present invention relates to a device for spreading paste on paperboard in a corrugated board manufacturing apparatus and, more particularly, to a device for spreading paste on tops of core paper corrugatedly supplied from a pair of stepped heating rollers to be pasted with linerboard.

2. Description of the Prior Art

In a conventional corrugated board manufacturing apparatus, pasting for core paper is conducted by a roll turning system in which liquid paste having low viscosity is dipped up by a paste spreading roller to be spread on top of the corrugated core paper, which is then pasted with linerboard. Therefore, it has been desired that the liquid paste spread on the tops of the corrugation is impasted to gel and have high viscosity by heat from the stepped heating rollers while the core paper is moved toward the linerboard.

However, in a conventional device, a predetermined volume of the liquid paste is constantly stored in a tank placed in the vicinity of the stepped rollers and, therefore, the liquid paste is exposed to heat radiation from the stepped rollers, leading to gelation and deterioration of the paste which cannot be satisfactorily dipped up by the paste spreading roller.

Further, the effective width of the paste spreading roller is in conformity with the maximum width in varieties of sizes of the core paper and, thus, in case the outer periphery of the paste spreading roller is continuously in contact with the liquid paste stored in the tank, the roller dips up the liquid paste in a full width thereof during rotation. Because of this, when core paper, which is smaller in width than the paste spreading roller is used, excessive paste runs over both sides of the core paper leading to inferior pasting of the core paper, spreading of the paste to the outer peripheries of the stepped rollers and a press roller, sticking of the core paper and the linerboard to the rollers and exfoliation and breakage of the core paper and the linerboard.

In consideration of these disadvantages, there has been provided a device in which a pair of partitions are movably placed in the paste tank to adjust the width of the paste spreading roller which is in contact with the liquid paste stored in the tank in conformity with the width of the core paper to be pasted (Japanese utility model publication No. 41-21028).

In this device, however, the liquid paste stored between the partitions is still exposed to heat radiation from the stepped rollers, resulting in deterioration of the paste and, further, tends to run over the partitions to be spread on the outer peripheries of the rollers, resulting in exfoliation and breakage of the core paper and the linerboard.

SUMMARY OF THE INVENTION

The object of the present invention is to overcome the aforementioned disadvantages of the prior art by providing a device for spreading paste on core paper in a corrugated board manufacturing apparatus which can prevent deterioration of the paste by heat and improper spreading of the paste on the core paper and spread the minimum required volume of the paste having appropriate properties on the core paper to facilitate efficient manufacturing of corrugated board of good quality.

In the device according to the present invention, liquid paste is continuously fed from a supplier such as a pump and a nozzle and flows through an inclined passage downwardly into a feeding portion at which a continuously rotating paste spreading roller dips up the paste. Since the paste is in a flowing condition, no deterioration such as gelation will occur in the paste even if the same is exposed to heat radiation from the stepped rollers for corrugatedly molding the core paper.

Further, the feeding portion provided in the forward end of the passage includes a pair of feeding end plates which are movable with respect to the axial center of the paste spreading roller for adjusting the width of the feeding portion in conformity with that of the core paper to be pasted. Therefore, the device according to the present invention can be applied to various sizes of core paper with a minimum required volume of the paste, and thereby prevents the paste from excessive spreading on the core paper and, the outer peripheries of rollers and further, prevents the core paper and the linerboard from breakage.

DESCRIPTION OF THE PREFERRED EMBODIMENT

Figure 1:
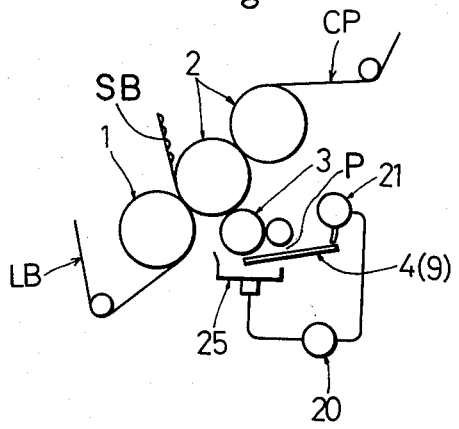
FIG. 1 is a schematically illustrated side elevational view of a corrugated board manufacturing apparatus to which the device according to the present invention is applied.
Figure 2:
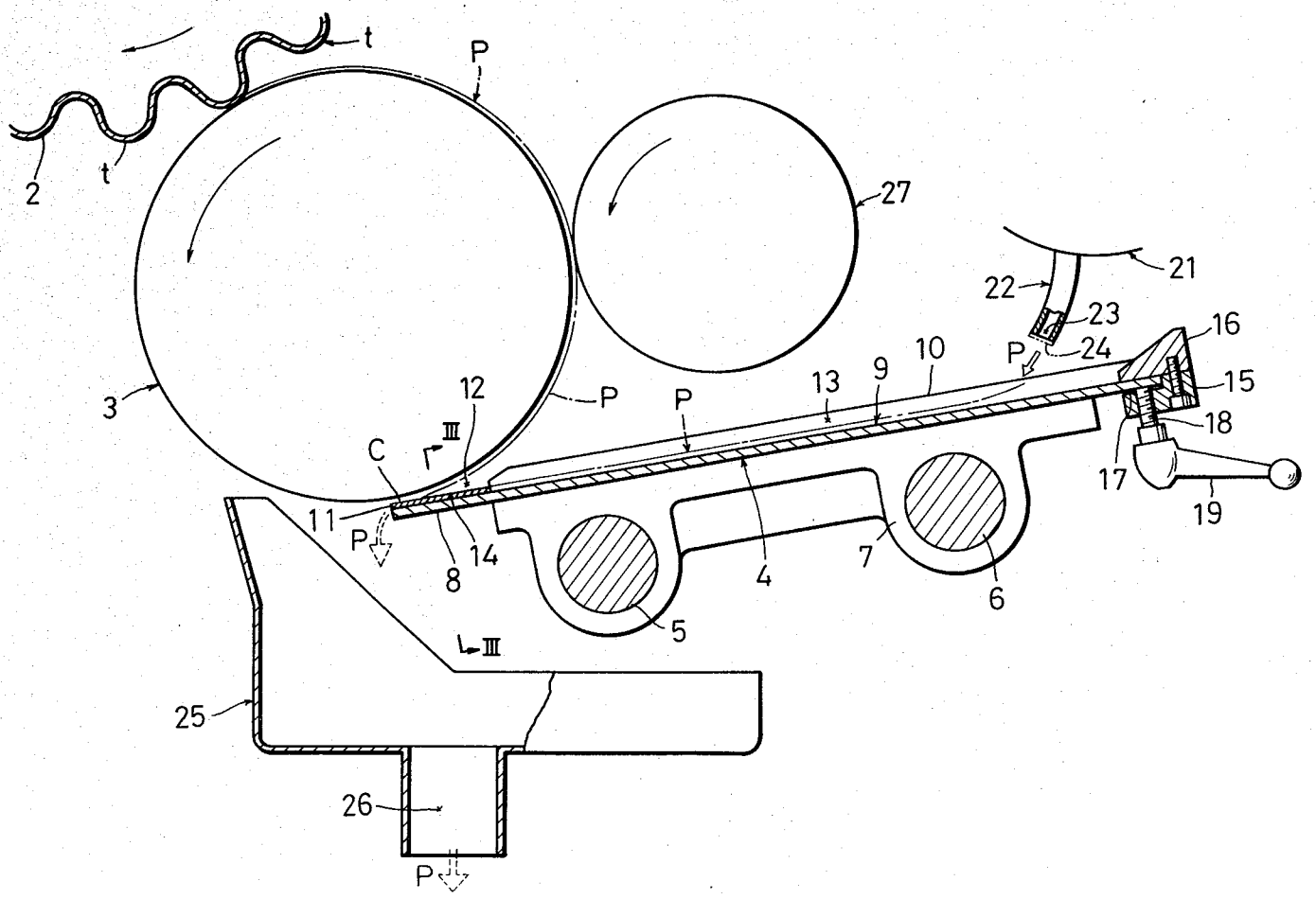
FIG. 2 is an enlarged longitudinal cross sectional view of the device according to the present invention.

Referring now to FIG. 1 of the drawings, there is shown a corrugated board manufacturing apparatus which includes a press roller 1 for supplying linerboard LB, a pair of stepped heating rollers 2 for supplying core paper CP while corrugatedly molding the same and a base plate 4 for feeding liquid paste P. The base plate 4 is formed by a rectangular flat plate which is longer in width than a paste spreading roller 3 oppositely provided against one of the stepped rollers 2. As shown in FIG. 2, the base plate 4 is supported by a pair of unevenly parallel supporting shafts 5 and 6 located along the axial direction of the paste spreading roller 3 through a pair of brackets 7, and is downwardly inclined toward the paste spreading roller 3. At the center of the forward end of the base plate 4, there is provided a feed plate 8 having effective width E2 for the paste P along the axial center of the paste spreading roller 3 and downwardly inclinedly extending below the roller 3 (see FIG. 4).

Figure 3:
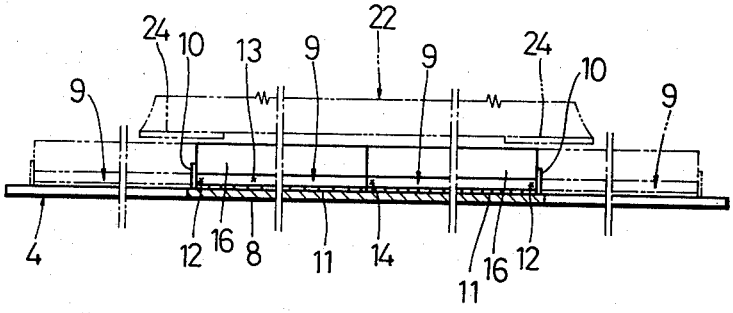
FIG. 3 is a partially fragmentary cross sectional view taken along line III—III in FIG. 2.

A pair of side plates 9 (FIGS. 3 and 4) are provided symmetrically about the longitudinal axis of the base plate 4 so that they are movable in contact with the upper end thereof. Each of the side plates 9 is formed by a remarkably thin flat plate, whose thickness is, for example, 0.5 mm. Along the longitudinal outer sides of the side plates 9, there are provided a pair of side walls 10 for preventing leakage of the liquid paste P, and plates extending from the forward ends of the side walls 10 and each having three open end portions in the form of feeding end plates 11. Each of the feeding end plates 11 has effective width E1 which is half the size as that of the feed plate 8 and extends under the paste spreading roller 3 defining a certain clearance C of, for example, 2 mm between the upper surface thereof and the outer periphery of the roller 3 (see FIG. 2). The outer open end of each feeding end plate 11 functions as a release portion 12 for the liquid paste P.

Figure 4:
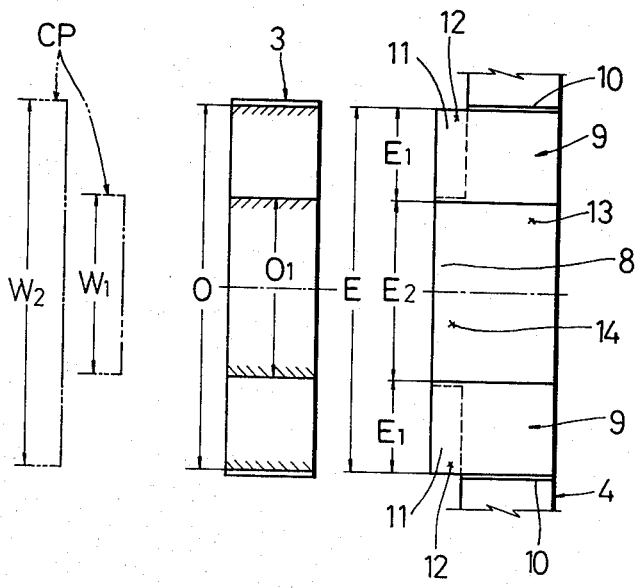
FIG. 4 is an illustrative top plan view showing members provided in the vicinity of the core paper.

As shown in FIG. 4, a passage 13 for the liquid paste P defined by the base plate 4 and the side plates 9 and a feeding portion 14 formed by the feed plate 8 and the feeding end plates 11 are identical in width, which width is adjustable between a minimum width W1 in which the side plates 9 are fully closed about the center of maximum effective outer surface O of the paste spreading roller 3 and a maximum width W2 in which the side plates 9 are fully opened in conformity with the varieties of the core paper CP between the minimum width W1 and the maximum width W2. Since, when the side plates 9 are fully opened, parts of the feed plate 8 and each feeding end plate 11 are overlapped, the effective width E2 of the feed plate 8 is shorter than its actual length, and the effective width E1 of each feeding end plate 11 is identical with the actual length thereof.

Further, since one of the supporting shafts 6 is vertically movable, the angle of the base plate 4 and the side plates 9 and the width of the clearance C are respectively adjustable.

A support 15 and a press member 16 are placed in contact with the lower and the upper surfaces of each side plate 9 respectively for proper location thereof and are connected with each other by a bolt. An extension 17 provided integrally with the support 15 is projected under the rear end of the base plate 4 to be tightened by a clamp screw 18 having a lever 19 to fix the side plate 9 in the predetermined position. By virtue of this, each side plate 9 is replaceably mounted with respect to the base plate 4 and is smoothly slidable in any direction by guidance of the support 15.

A pump 21 is provided above the rear end of the base plate 4 to continuously pump up the liquid paste P from a tank 20 which is separately provided under the stepped rollers 2 and to supply the liquid paste P to the base plate 4 and the side plates 9 from a nozzle 22 downwardly extending therefrom. The nozzle 22 is, for example, rectangular in section and smoothly curved in the longitudinal direction and a port 23 thereof is faced transversely to the passage 13. A cover 24 of proper size is replaceably mounted to the port 23 at need, to adjust the width of the port 23.

A receptacle 25 is provided under the paste spreading roller 3 and the forward end of the base plate 4 to collect the liquid paste P falling from the feed plate 8 and the feeding end plates 11 and return the same to the tank 20 through a pipe 26. The receptacle 25 may be in the form of a funnel.

A roller 27 is provided to face the paste spreading roller 3 and the space therebetween is adjustable to control the volume of the liquid paste P with respect to the core paper CP.

Such control of the volume of the liquid paste P, adjustment of the inclination of the base plate 4 and adjustment of the movement of the side plates 9 are all achieved by means of graduations.

In operation with narrow width core paper which is hard to achieve satisfactory pasting and of which width is the minimum one W1, each clamp screw 18 is loosened and then tightened to fully close the side plates 9 and conform the passage 13 and the feeding portion 14 to the minimum width W1. In this condition, the liquid paste P supplied from the nozzle 22 to the rear ends of the side plates 9 by the continuous operation of the pump 21 flows down through the passage 13 into the feeding portion 14.

Following the aforementioned setting of the effective width of the feeding portion 14, effective minimum width E1 of the outer surface O of the paste spreading roller 3 is determined and thus, the paste spreading roller 3 rotating reversely to the direction of flow of the liquid paste P continuously dips up the liquid paste P flowing into the feeding portion 14 within the range of the minimum width E1 of the outer surface O thereof.

In such operation, unused liquid paste P falls from the feeding end plates 11 into the receptacle 25 to be returned to the tank 20. When excess volume of the liquid paste P flows into the feeding portion 14, the overflown paste is discharged from the release portion 12 of each feeding end plate 11 into the receptacle 25 so that the liquid paste P in the feeding portion 14 is continuously kept at a fixed volume and ceaselessly keeps flowing. Under this condition, the paste spreading roller 3 smoothly dips up the required minimum volume of the liquid paste P.

The liquid paste P thus dipped up is controlled in volume while passing through the roller 27 and fed to the paste spreading roller 3, and uniformly spread successively to the tops t of the core paper CP corrugatedly molded by the stepped rollers 2.

Then the tops t and the linerboard LB are pasted with each other to form single corrugated board SB of good quality.

The liquid paste P falling from the roller 27 is returned to the side plates 9 and reused.

In operation with core paper having the maximum width W2, the side plates 9 are fully opened so that the passage 13 defined by the side plates 9 and the base plate 4 and the feeding portion 14 defined by the feeding end plates 11 and the feed plate 8 are in conformity with the maximum effective width W2.

In this condition, the liquid paste P supplied from the nozzle 22 flows through the passage 13 into the feeding portion 14 to be continuously dipped up by the paste spreading roller 3 within the maximum width W2 and spread successively to the tops t of the corrugated core paper CP.

Thus, the width of the passage 13 defined by the side plates 9 is determined so that the feeding portion 14 is aligned in effective width with the core paper CP, leading to smooth and uniform pasting by the paste spreading roller 3.

Figure 5:
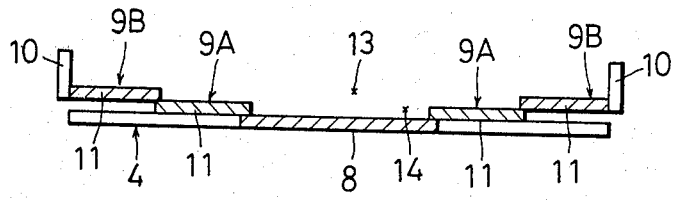
FIG. 5 is a transverse cross sectional view showing a modification of the paste feeding members.
Figure 6:
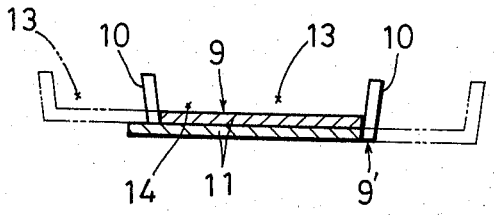
FIG. 6 is a transverse cross sectional view showing another modification of the paste feeding members.
Figure 7:
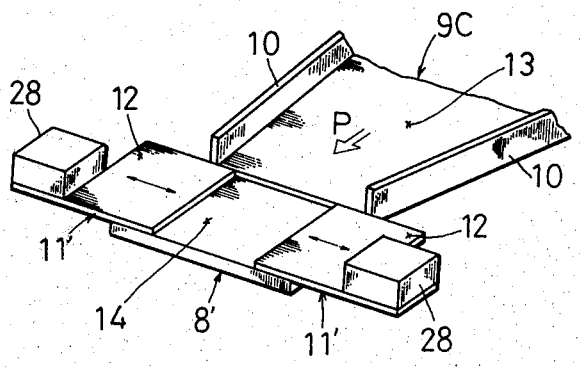
FIG. 7 is a perspective view showing still another modification of the paste feeding members.

Attention is now drawn to FIGS. 5 to 7, in which modifications of the paste feeding members are shown.

In FIG. 5, the base plate 4 is provided thereon with a pair of inner side plates 9A and a pair of outer side plates 9B having the side walls 10 which can be superposed on the inner side plates 9A. The inner and outer side plates 9A and 9B are both slidable along the base plate 4 with respect to the axial center of the paste spreading roller 3 and can be overlapped with each other to adjust the effective width of the feeding portion 14.

In FIG. 6, there are provided side plates 9 and 9' having the side walls 10, which are different in width and overlappingly slidable to adjust the effective width with respect to the passage 13 defined by the side plates 9 and 9' and the feeding portion 14 defined by the feeding end plates 11 between the minimum one in a fully closed condition as shown in full lines and the maximum one in a fully opened condition as shown in phantom lines.

Further, in FIG. 7, there are provided a trapezoidal stationary plate 9C having the side walls 10 and defining the passages 13, a feed plate 8' secured to the forward end of the plate 9C and a pair of feeding end plates 11' slidably mounted on the feed plate 8' to define the feeding portion 14 communicating with the passage 13. The end plates 11' have blocks 28 in the forward outer ends thereof to define the release portions 12.

In either of the aforementioned modifications, a means, such as a slit and a bolt, a dovetail and a bolt or a turnbuckle having a handle, can be employed for proper location of the side plates 9A, 9B, 9 and 9' and the movable feeding end plates 11'.

Further, the device according to the present invention can be used for various kinds of composition board other than the single side corrugated board.

While the invention has been described with reference to a preferred embodiment thereof, it is to be understood that modifications or variations may be easily made without departing from the scope of this invention which is defined by the appended claims.

What is claimed is:

1. In a corrugated board manufacturing apparatus, a device for spreading paste on tops of corrugated core paper to be pasted with linerboard, said device comprising:

a supplier for supplying liquid paste;

a roller spaced from said supplier to face said tops of said core paper for spreading said liquid paste thereon;

means provided opposite to said paste spreading roller for controlling the volume of said liquid paste;

paste means provided under said supplier downwardly inclining toward said paste spreading roller and having a forward end in proximity with said paste spreading roller to define a passage for continuously flowing said liquid paste supplied from said supplier past said paste spreading roller;

said paste feeding means comprising:

at least a pair of end plates oppositely provided in the forward end of and on top of said paste feeding means defining a certain clearance between the upper surfaces thereof and said paste spreading roller, said end plates being longitudinally movable with respect to the roll axis of said paste spreading roller; and whereby a feed portion is defined by said end plates and communicates with said passage in which said paste spreading roller dips up paste, the width of said feed portion being adjustable by movement of said end plates in conformity with the width of said core paper between a minimum effective width and a maximum effective width.

2. The device as defined in claim 1 wherein said feed portion is further defined by a plate provided at the center of the forward end of said paste feeding means to communicate with said passage, on which said pair of end plates are slidably mounted.

3. The device as defined in claim 1 wherein said paste feeding means comprises a rectangular flat base plate and a pair of side plates provided on both sides of said base plate symmetrically about the longitudinal axis thereof, and said passage is defined by said flat base plate and said side plates.

4. The device as defined in claim 3 wherein said side plates are movable in contact with the upper end of said base plate, and are provided with a pair of side walls along the longitudinal outer sides thereof.

5. The device as defined in claim 3 wherein said base plate is supported by a pair of unevenly parallel supporting shafts through a pair of brackets.

6. The device as defined in claim 1 wherein said paste feeding means comprises a rectangular flat base plate, a pair of inner side plates provided on both sides of said base plate and another pair of outer side plates capable of being superposed on said inner side plates, and said inner and outer side plates are both slidable along said base plate to be overlapped with each other to adjust said width of said feed portion.

7. The device as defined in claim 1 wherein said paste feeding means comprises a pair of plates which are different in width and overlappingly slidable to adjust said effective width with respect to said passage and said feed portion, both defined by said plates.

8. The device as defined in claim 1 wherein said paste feeding means comprises a stationary plate defining said passage, and said feed portion is further defined by a plate provided at the forward end of said stationary plate to communicate with said passage, on which said pair of end plates are slidably mounted.

9. The device as defined in claim 1 further including a tank connected to said supplier for storing said liquid paste, a receptacle provided under said paste spreading roller and said feed portion for collecting said liquid paste falling therefrom and a pipe connecting said receptacle to said tank for returning said collected liquid paste to said tank.

* * * * *